United States Patent [19]

Lischerelli

[11] Patent Number: 4,998,729

[45] Date of Patent: Mar. 12, 1991

[54] GAME BOARD

[76] Inventor: Christopher A. Lischerelli, 2212 Market St., Erie, Pa. 16510

[21] Appl. No.: 506,931

[22] Filed: Apr. 10, 1990

[51] Int. Cl.[5] ..... A63F 7/00

[52] U.S. Cl. ..... 273/119 R; 273/118 R; 273/123 R

[58] Field of Search ..... 273/119, 120, 121, 122, 273/123, 124, 125

[56] References Cited

U.S. PATENT DOCUMENTS

| | | | |
|---|---|---|---|
| 466,891 | 1/1892 | Garrett | 273/119 R |
| 751,189 | 2/1904 | Matthews | 273/119 R |
| 2,237,486 | 4/1941 | Henderson | 273/119 R |
| 2,841,398 | 7/1958 | Conner | 273/119 R |
| 3,669,452 | 6/1972 | Foley et al. | 273/119 R |
| 4,046,380 | 9/1977 | Goldfarb et al. | 273/119 R |
| 4,585,235 | 4/1986 | Williams | 273/119 R |

FOREIGN PATENT DOCUMENTS

| | | | |
|---|---|---|---|
| 2711630 | 9/1978 | Fed. Rep. of Germany | 273/119 R |

*Primary Examiner*—Edward M. Coven
*Assistant Examiner*—Raleigh W. Chiu
*Attorney, Agent, or Firm*—Charles L. Lovercheck; Wayne L. Lovercheck; Dale Lovercheck

[57] ABSTRACT

A game board comprising a bottom, and a false bottom supported on the bottom by spacers, barriers on the false bottom providing spaces defining entrances to pockets. Pairs of swingable arms swingably supported on the false bottom to project marbles toward another entrance and to guard marbles from entering the spaces between the barriers, whereby marbles passing said arms into said pockets are lost to certain players.

3 Claims, 2 Drawing Sheets

GAME BOARD

BACKGROUND OF INVENTION

Game boards wherein balls or marbles are used are well known. This invention relates to a game board, more particularly to a game board that utilizes swingable arms to project balls directing the balls to pockets and enables a selected number of persons to play the game involving a selected number of playing arrangements.

Applicant is aware of the following U.S. Pat. Nos.:

| | |
|---|---|
| 602,179 to Haskell | 1,512,442 to Arnold |
| 607,031 to Gilbert | 2,089,514 to Walker |
| 635,059 to Pike | 2,507,258 to Kohler |
| 641,410 to Shaw | 3,741,544 to Wolff, Jr. |

However, applicant knows of no patent that has the salient features of the games that has been described and claimed herein.

STATEMENT OF INVENTION

A feature of the present game boars is that it can be made either square or round with a suitable number of positions for different numbers of two or more players.

The game board is simple in construction, but presents an interesting challenge to the dexterity, judgment and coordination of the player.

It is an object of the invention to provide an improved game board.

Another object of the invention is to provide a board game which involves skilled and mechanical dexterity and is interesting to play.

Another object in to provide a game board that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DESCRIPTION OF THE PREFERRED EMBODIMENTS

Figure 1:
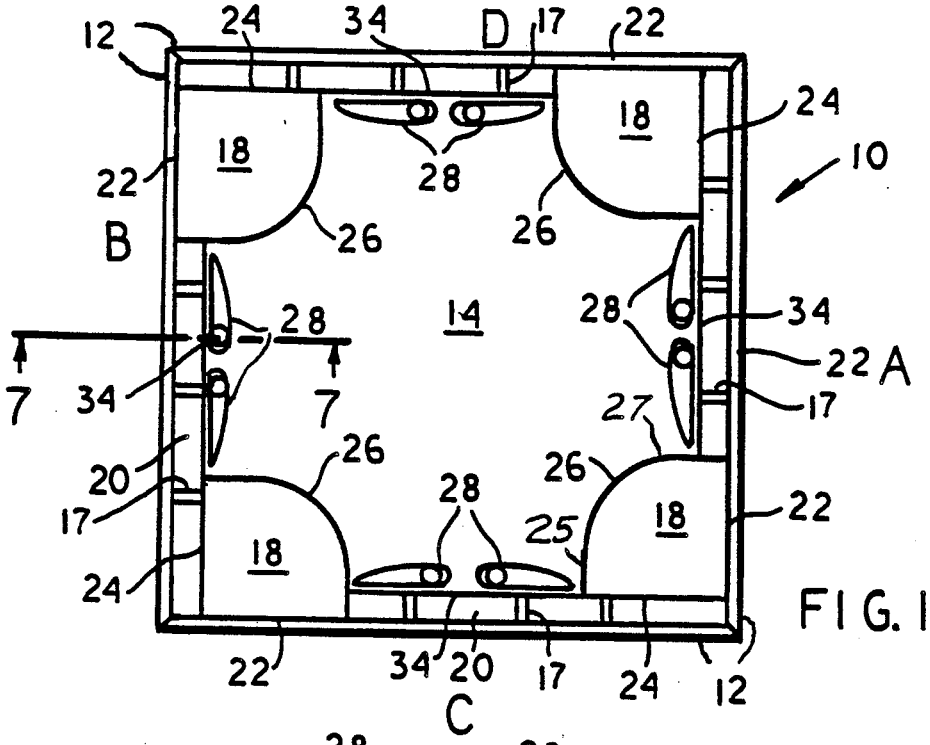
FIG. 1 is a top view of one embodiment of the invention.

Now with more particular reference to the embodiment of the invention shown in FIG. 1, game board 10 is shown having bottom 11, with side walls 12 attached to the marginal edges of bottom 11 and extending upwardly therefrom and joining one another at four board corners. Game board 10 may be made of plywood, particle board, sheet plastic, masonite or molded plastic at the discretion of designer. Spacers 16 are supported on bottom 11 and supper false bottom 14 in spaced relation above to provide a playing surface. False bottom 14 terminates in spaced relation to side walls 12 and provides pockets 20 between side walls 12 and the outer edges of false bottom 14. Pockets 20 have partitions 17 which extend from side walls 12 to false bottom 14.

Barriers 18 are supported on false bottom 14, extended upwardly therefrom and provide barriers to deflect marbles 40 that may be projected across game board 10. Barriers 18 have two adjacent straight sides 22 and 24 that are disposed at right angles to one another defining a barrier corner. First straight side 22 of each barrier 18 engages one of side walls 12. Curved sides 26 of each barrier 18 are arcuate shaped and extend from first straight side 22 adjacent wall 12 and terminate at a straight side 24 at a false bottom edge 34. Each pocket 20 is defined by bottom 11, one side wall 12 and an edge of false bottom 14.

Each barrier has first straight side 22, second straight side 24, third straight side 25, fourth straight side 27 and curved side 26. First straight side 22 joins second straight side 24 at a first barrier corner. Second straight side 24 joins third straight side 25 at a second barrier corner. Third straight side 25 joins fourth straight side 27 at a third barrier corner. Third straight side 25 and fourth straight side 27 joins curved side 26. Each third straight side 25 and fourth straight side 27 being tangent to curved side 26. First straight side 22 of each barrier is disposed substantially against a side wall. Second straight side 24 of each barrier is generally coextensive with a peripheral edge of false bottom 14.

Four parts of swinging arms 28 are provided; each having a handle 30 fixed thereto. Each pair of arms 28 is supported on an axle 32 having head 42, extends upward through false bottom 14 and into hole 38. Each arm 28 has a thickness in a vertical direction approximately equal to the thickness of barriers 18.

By using arms 28, each player A, B, C, or D, playing the game shown in FIG. 1, can project marbles 40 and guards pocket 20 that may be at his particular side of game board 10. The idea of the game being for a player to try to get marbles 40 in to the opponent's pocket 20 and to try to prevent the opponent from getting all of his marbles 40 into the player's pocket 20. The game can be played by any of several procedures. For example, each player may be given a predetermined number of marbles 40. A first player A, would project his marbles 40, one by one, using arms 28 at his particular side of game board 10. The next player at the opposite side B, using arms 28 on his side, try to return marbles 40 and try to keep marbles 40 out of pocket 20 at his side of game board 10. The next player C would then in turn, project his marbles 40 across game board 10 by means of arms 28 adjacent his side. Any player would maneuver arms 28 at his side in an effort to prevent a marble 40 from entering pocket 20 on his side of game board 10. When any player has lost all of his marbles 40 into any of pockets 20, that player would lose. The game can be played with several different sets of rules or combinations of rules. For example, if four players are involved, they can play as two sets of partners or each of the players could play as an individual.

Figure 2:
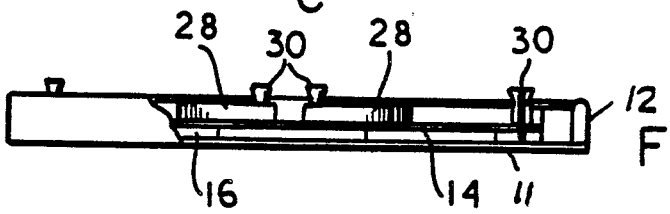
FIG. 2 is an end view of the board shown in FIG. 1, with part of one end removed.
Figure 9:
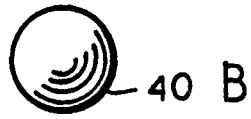
FIG. 9 is a view of a marble for use with the game board.
Figure 3:
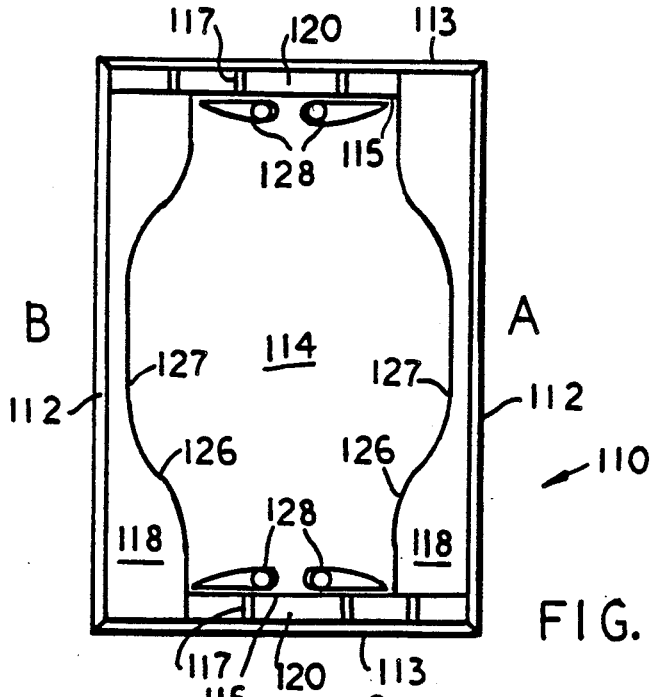
FIG. 3 is a top view of another embodiment of the invention.
Figure 4:
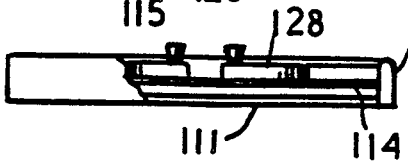
FIG. 4 is an end view of the board shown in FIG. 3, with part of one end removed.

Now with more particular reference to the embodiment of the invention shown in FIGS. 3 and 4, game board 110 is set up for two players, A and B. Game board 110 has bottom 111 and side walls 112 that may be supported on the edges of bottom 111. False bottom 114 provides support for barriers 118. False bottom 114 has peripheral edges that engage side walls 112 and marginal edges 115 of the playing surface of false bottom 114. Pockets 120 are formed by the space between marginal edges 115 of false bottom 114 and end walls 113. Each barrier 118 extends along a side wall 112 and is disposed in spaced relation to end wall 113. Pockets 120 have partitions 117 extending from side walls 112 to false bottom 114. Barriers 118 have small curved edges 126 and large curved edge 127. Arms 128, similar to arms 28 shown in FIG. 1, are pivoted to false bottom 114. Game board 110, shown in the embodiment of FIGS. 3 and 4, is played much the same way as the game shown in the embodiment of FIGS. 1 and 2 except it is especially suited for two players A and B.

Figure 5:
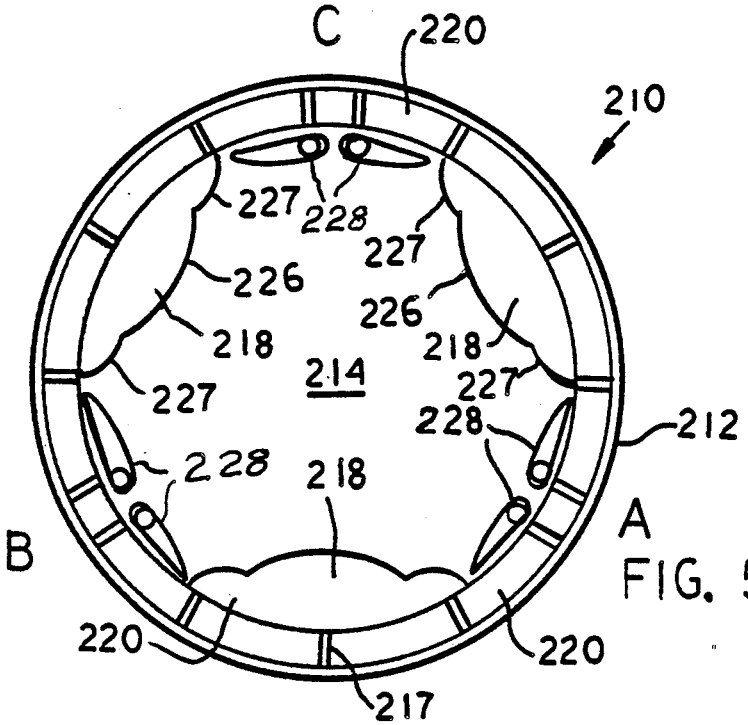
FIG. 5 is a top view of another embodiment of the invention.
Figure 6:
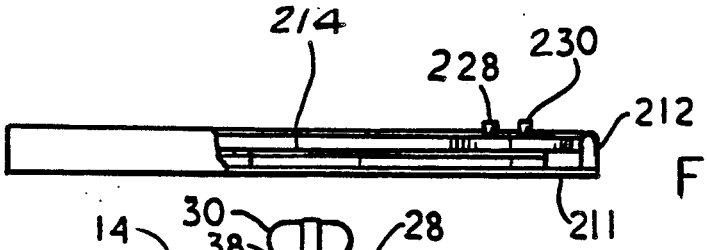
FIG. 6 is an end view of the embodiment of the invention shown in FIG. 5, with part of an end removed.
Figure 7:
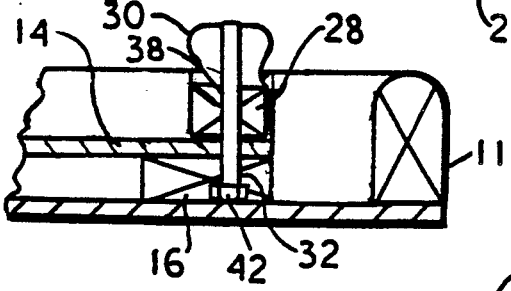
FIG. 7 is a partial enlarged cross sectional view taken on line 7—7 of FIG. 1.
Figure 8:
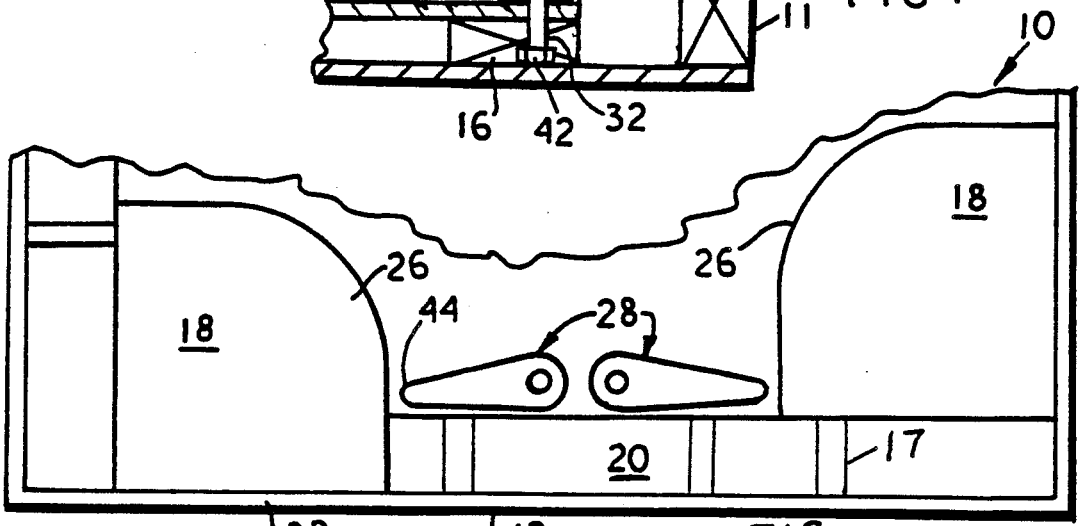
FIG. 8 is a partial enlarged view of FIG. 1.

Now with more particular reference to the embodiment of the invention shown in FIGS. 5 and 6, game board 210 has bottom 211, which is round in configuration, side wall 212 which are also circular, pockets 220 are between side wall 212 and barriers 218. Barriers 218 each have one large curved edge 226 and two small curved edges 227 facing corresponding opposite surfaces on other barriers 218. Game board 210 also has three pairs of arms 228, similar to arms 28 and 128 shown in the other embodiments of the invention, and false bottom 214. Partitions 217 are provided as spaced positions in pockets 220. Partitions 217 reinforce game board 210 and separate marbles 40 in pockets 220. Game board 220, shown in FIGS. 5 and 6, is suited for use by three players, A, B and C and may be played by rules similar to the rules by which the game in the other embodiments of the invention are played.

The foregoing specification sets forth the invention in its preferred, practical forms but the structure shown is capable of modification within a range of equivalents without departing from the invention which is to be understood is broadly novel as is with the appended claims.

The embodiments of the invention in which an exclusive property or privilege is claimed are defined as follows:

1. In combination, a game board and marbles, said game board being generally rectangular and comprising a bottom and having four side walls supported on said bottom extending upwardly therefrom defining four board corners and a false bottom, spacers supported on said bottom supporting said false bottom, spaced barriers supported on said false bottom adjacent each said board corner of said game board, said spaced barriers defining a playing area on the central part of said false bottom, each said spaced barrier having a first straight side, a second straight side, a third straight side, a fourth straight side and a curved side, said first straight side joining said second straight side at a first barrier corner, said second straight side joining said third straight side at a second barrier corner, said first straight side joining said fourth straight side at a third barrier corner, said third straight side and said fourth straight side joining said curved side, each said third straight side and said fourth straight side being tangent to said curved side, said first straight side of each said barrier being disposed substantially against one of said side walls, said second straight side of said barrier being generally coextensive with a peripheral edge of said false bottom, each of said peripheral edges of said false bottom terminating in spaced relation to said side walls providing pockets for said marbles therebetween, a pair of swingable arms having a first end and a second end, said first end of each said swingable arm being swingably attached to and supported on said false bottom and disposed in spaced relation to one another adjacent said peripheral edges of said false bottom and between two of said space barriers, each of said swinging arms having a handle attached thereto whereby a player can rotate said handles thereby swinging a said arm to project said marbles or to prevent said marbles projected by another player toward a particular player from going into a said pocket adjacent said swinging arms, said second ends of said swingable arms being adapted to swing substantially close to said third straight side of said spaced barriers when said swingable arms are swung outwardly.

2. The combination recited in claim 1 wherein said game board has two said spaced barriers and two said pockets for two players to play on said game board.

3. The combination recited in claim 1 wherein each said curved side extending from one side wall to one said peripheral edge of said false bottom, each said curved side defining a space with another said curved side for said marbles to pass into a said pocket.

* * * * *